US008959921B2

(12) United States Patent
Khan et al.

(10) Patent No.: US 8,959,921 B2
(45) Date of Patent: Feb. 24, 2015

(54) FLAME TOLERANT SECONDARY FUEL NOZZLE

(75) Inventors: Abdul Rafey Khan, Greenville, SC (US); Willy Steve Ziminsky, Greenville, SC (US); Chunyang Wu, Greenville, SC (US); Baifang Zuo, Greenville, SC (US); Christian Xavier Stevenson, Greenville, SC (US)

(73) Assignee: General Electric Company, Schenectady, NY (US)

( * ) Notice: Subject to any disclaimer, the term of this patent is extended or adjusted under 35 U.S.C. 154(b) by 1106 days.

(21) Appl. No.: 12/835,227

(22) Filed: Jul. 13, 2010

(65) Prior Publication Data

US 2012/0011854 A1 Jan. 19, 2012

(51) Int. Cl.

| | |
|---|---|
| ***F23R 3/14*** | (2006.01) |
| ***F23R 3/28*** | (2006.01) |
| ***F23R 3/34*** | (2006.01) |
| ***F23R 3/04*** | (2006.01) |

(52) U.S. Cl.

CPC . *F23R 3/283* (2013.01); *F23R 3/14* (2013.01); *F23R 3/34* (2013.01); *F23R 3/04* (2013.01); *F23R 3/286* (2013.01); *F23D 2214/00* (2013.01); *F23R 2900/03044* (2013.01)

USPC ..... 60/737

(58) Field of Classification Search

CPC ..... F23R 3/283; F23R 3/286; F23R 3/14; F23R 3/04; F23R 3/34

USPC ..... 60/754, 772, 736, 737

See application file for complete search history.

(56) References Cited

U.S. PATENT DOCUMENTS

| | | | | |
|---|---|---|---|---|
| 4,986,068 | A * | 1/1991 | Lee et al. | 60/768 |
| 5,193,346 | A | 3/1993 | Kuwata et al. | |
| 5,199,265 | A | 4/1993 | Borkowicz | |
| 5,259,184 | A | 11/1993 | Borkowicz et al. | |
| 5,490,378 | A | 2/1996 | Berger et al. | |
| 5,575,146 | A | 11/1996 | Borkowicz et al. | |
| 5,590,529 | A | 1/1997 | Joshi et al. | |
| 5,685,139 | A | 11/1997 | Mick et al. | |
| 5,778,676 | A | 7/1998 | Joshi et al. | |
| 6,301,899 | B1 | 10/2001 | Dean et al. | |
| 6,363,724 | B1 | 4/2002 | Bechtel et al. | |
| 6,438,961 | B2 | 8/2002 | Tuthill et al. | |
| 6,681,578 | B1 | 1/2004 | Bunker | |
| 6,993,916 | B2 | 2/2006 | Johnson et al. | |
| 7,165,405 | B2 * | 1/2007 | Stuttaford et al. | 60/737 |
| 2006/0010878 | A1 * | 1/2006 | Widener | 60/776 |
| 2007/0074518 | A1 * | 4/2007 | Rogers et al. | 60/776 |
| 2008/0078183 | A1 * | 4/2008 | Ziminsky et al. | 60/776 |
| 2009/0084110 | A1 * | 4/2009 | Dudebout et al. | 60/754 |
| 2009/0249789 | A1 | 10/2009 | Zuo et al. | |
| 2010/0101229 | A1 * | 4/2010 | York et al. | 60/737 |
| 2010/0192582 | A1 * | 8/2010 | Bland et al. | 60/737 |

* cited by examiner

*Primary Examiner* — Lindsay Low
*Assistant Examiner* — Jacob Amick
(74) *Attorney, Agent, or Firm* — Nixon & Vanderhye P.C.

(57) ABSTRACT

A combustor for a gas turbine engine includes a plurality of primary nozzles configured to diffuse or premix fuel into an air flow through the combustor; and a secondary nozzle configured to premix fuel with the air flow. Each premixing nozzle includes a center body, at least one vane, a burner tube provided around the center body, at least two cooling passages, a fuel cooling passage to cool surfaces of the center body and the at least one vane, and an air cooling passage to cool a wall of the burner tube. The cooling passages prevent the walls of the center body, the vane(s), and the burner tube from overheating during flame holding events.

21 Claims, 8 Drawing Sheets

FLAME TOLERANT SECONDARY FUEL NOZZLE

STATEMENT REGARDING FEDERALLY SPONSORED RESEARCH OR DEVELOPMENT

This invention was made with Government support under Contract No. DE-FC26-05NT42643 awarded by the Department of Energy. The Government has certain rights in this invention.

FIELD OF THE INVENTION

The present invention relates to a flame tolerant secondary fuel nozzle in a premixer that includes cooling.

BACKGROUND OF THE INVENTION

Secondary nozzles in a combustor of a gas turbine may be permanently damaged when a flame is held in the premixing section of the nozzle. The use of high reactivity fuels makes this possibility more likely and confines operability of the gas combustor in a limited fuel space.

Use of high reactivity fuels increases flame holding risk that causes hardware damage and makes it more difficult to operate these fuels under premix operation. This has been previously addressed by so-called partially premixed design concepts that compromise mixing versus flame holding risk and increases NOx emissions.

Referring to FIG. 1, an exemplary gas turbine 12 includes a compressor 14, a dual stage, dual mode combustor 16 and a turbine 18 represented by a single blade. Although not specifically shown, the turbine 18 is drivingly connected to the compressor 14 along a common axis. The compressor 14 pressurizes inlet air which is then turned in direction or reverse flowed to the combustor 16 where it is used to cool the combustor and also used to provide air to the combustion process. The gas turbine 12 includes a plurality of the combustors 16 (one shown) which are located about the periphery of the gas turbine 12. A transition duct 20 connects the outlet end of its particular combustor 16 with the inlet end of the turbine 18 to deliver the hot products of the combustion process to the turbine 18.

Referring to FIGS. 1 and 2, each combustor comprises a primary or upstream combustion chamber 24 and a second or downstream combustion chamber 26 separated by a venturi throat region 28. The combustor is surrounded by a combustor flow sleeve 30 which channels compressor discharge air flow to the combustor. The combustor is further surrounded by an outer casing 31 which is bolted to the turbine casing 32.

Primary nozzles 36 provide fuel delivery to the upstream combustion chamber 24 and are arranged in an annular array around a central secondary diffusion nozzle 38. Each combustor may include six primary nozzles and one secondary nozzle, although it should be appreciated that other arrangements may be provided. Fuel is delivered to the nozzles through plumbing 42. Ignition in the primary combustor is caused by spark plug 48 and in adjacent combustors by crossfire tubes 50.

Referring to FIG. 2, a primary diffusion nozzle 36 includes a fuel delivery nozzle 54 and an annular swirler 56. The nozzle 54 delivers only fuel which is then subsequently mixed with swirler air for combustion. The centrally located secondary nozzle 38 contains a major fuel/air premixing passage and a pilot diffusion nozzle.

During base-load operation, the dual stage, dual mode combustor is designed to operate in a premix mode such that all of the primary nozzles 36 are simply mixing fuel and air to be ignited by the secondary premixed flame supported by the secondary nozzle 38. This premixing of the primary nozzle fuel and ignition by the secondary pilot diffusion nozzle leads to a lower NOx output in the combustor.

Referring still to FIG. 2, a diffusion piloted premix nozzle 100 includes a diffusion pilot having a fuel delivery pipe. The diffusion pilot further includes an air delivery pipe coaxial with and surrounding the fuel delivery axial pipe portion. The air input into the air delivery pipe is compressor discharge air which is reverse flowed around the combustor 16 into the volume 76 defined by the flow sleeve 30 and the combustion chamber liner 78. The diffusion pilot includes at its discharge end a first or diffusion pilot swirler for the purpose of directing air delivery pipe discharge air to the diffusion pilot flame.

A premix chamber 84 is defined by a sleeve-like truncated cone which surrounds the diffusion pilot and includes a discharge end (as shown by the flow arrows) terminating adjacent the diffusion pilot discharge end. Compressor discharge air is flowed into the premix chamber 84 from volume 76 in a manner similar to the manner in which air is supplied to the air delivery pipe. The plurality of radial fuel distribution tubes extend through the air delivery pipe and into the premix chamber 84 such that the injected fuel and air are mixed and delivered to a second or premix chamber swirler annulus between the diffusion pilot and the premix chamber truncated cone. Further details of the combustor and gas turbine engine shown in FIGS. 1 and 2 are disclosed in, for example, U.S. Pat. No. 5,193,346

BRIEF DESCRIPTION OF THE INVENTION

According to one embodiment of the invention, a combustor for a gas turbine engine comprises a plurality of primary nozzles configured to diffuse fuel into an air flow through the combustor; and a secondary nozzle configured to premix fuel with the air flow, the secondary nozzle comprising a fuel passage, a center body provided around the fuel passage, a burner tube provided around the center body and defining an annular air-fuel mixing passage between the center body and the burner tube, at least one vane in the annular air-fuel mixing passage configured to swirl the air flow, and at least two cooling passages comprising a fuel cooling passage to cool surfaces of the center body and the at least one vane, and an air cooling passage to cool a wall of the burner tube.

According to another embodiment of the invention, a method of operating a combustor of a gas turbine engine is provided. The combustor comprises a plurality of primary nozzles provided in a primary combustion chamber and configured to diffuse fuel of a fuel supply to the combustor into an air flow through the combustor; and a secondary nozzle provided in a secondary combustion chamber and configured to premix fuel of the fuel supply with the air flow, the secondary nozzle comprising a fuel passage, a center body provided around the fuel passage, a burner tube provided around the center body and defining an annular air-fuel mixing passage between the center body and the burner tube, at least one vane in the annular air-fuel mixing passage configured to swirl the air flow, and at least two cooling passages comprising a fuel cooling passage to cool surfaces of the center body and the at least one vane, and an air cooling passage to cool a wall of the burner tube. The method comprises providing an air flow to the combustor; and providing a fuel supply to at least one of the plurality of primary nozzles and the secondary nozzle; diffusing any fuel supplied to the primary nozzles into the air flow; premixing any fuel supplied to the secondary nozzle with the air flow; cooling the center body and the at least one vane with a portion of the fuel in the fuel cooling passage; and cooling the burner tube with a portion of the air flow between the burner tube and an outer peripheral wall.

DETAILED DESCRIPTION OF THE INVENTION

Figure 1:
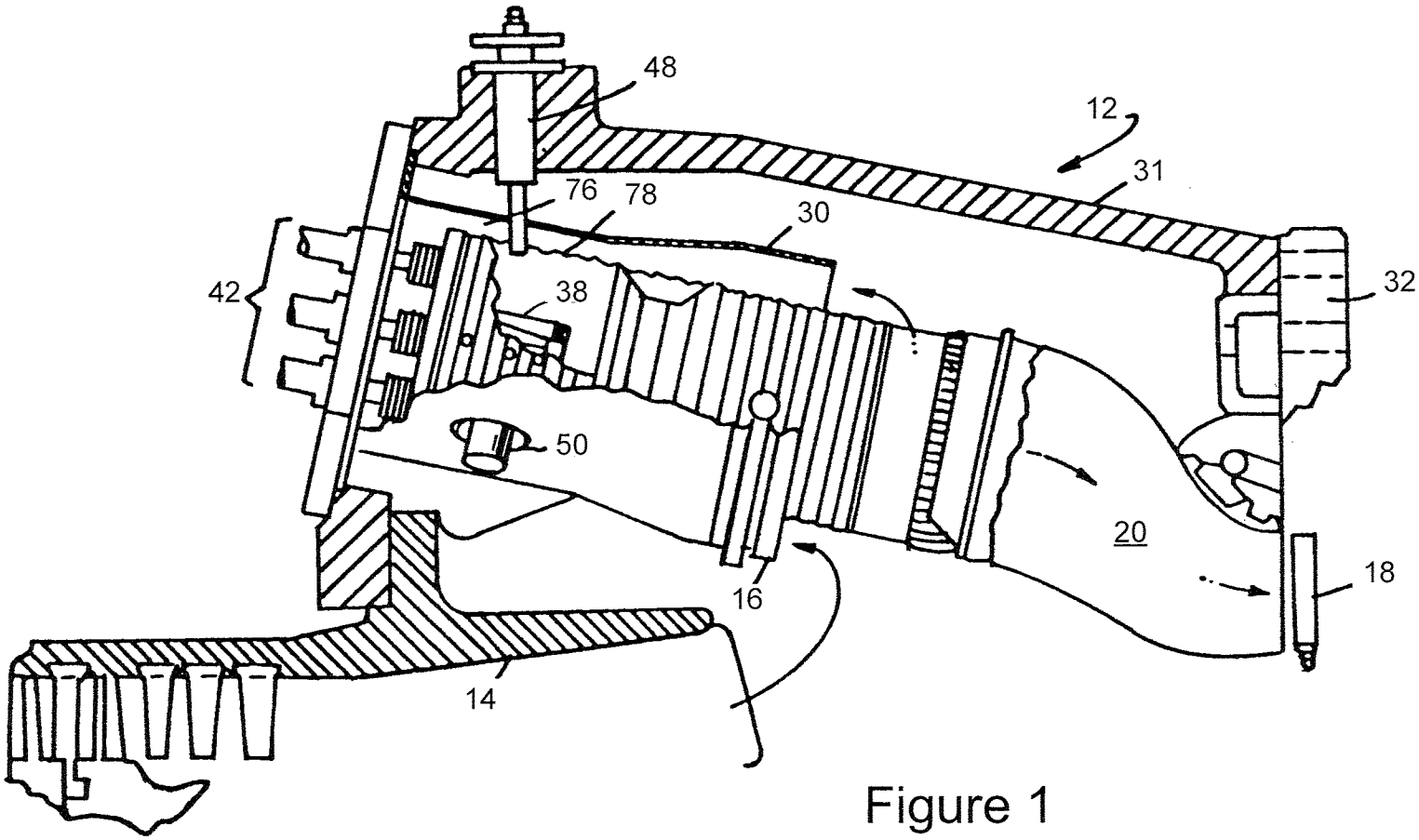
Figure 1 Prior Art
FIG. 1 is an elevation view of a gas turbine engine according to the prior art shown in partial cross section.
Figure 2:
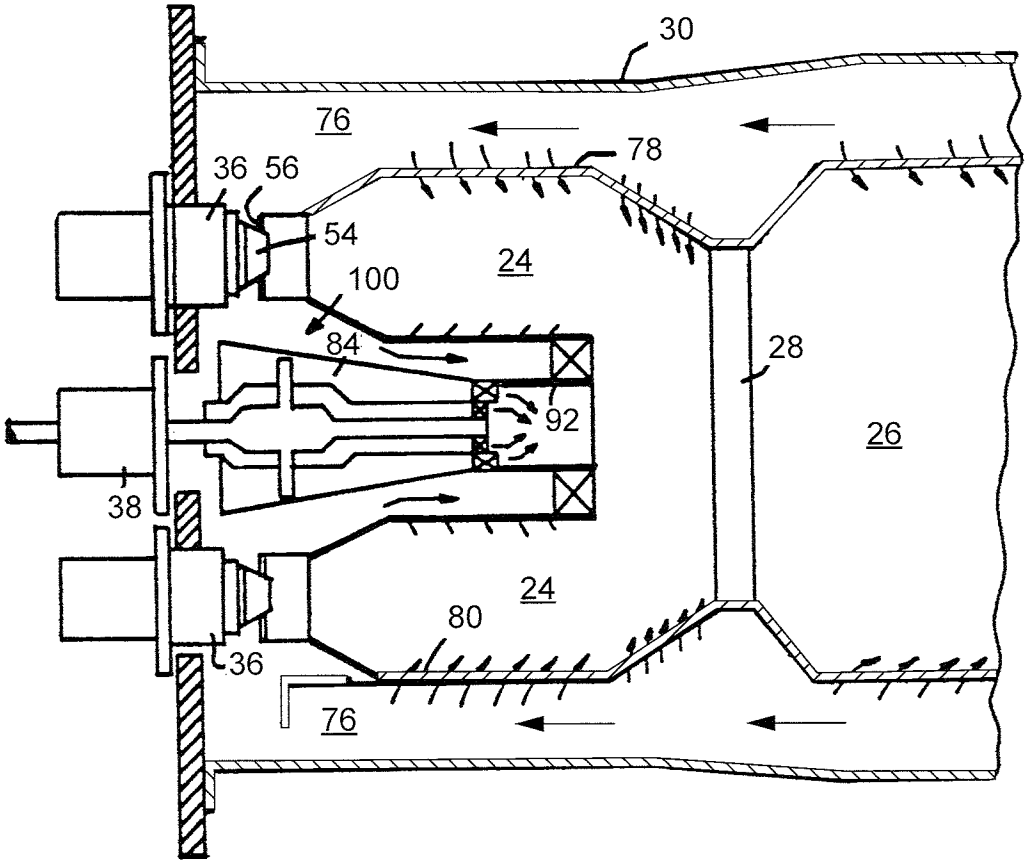
Figure 2 Prior Art
FIG. 2 is an enlarged detail elevation view of a combustor section of the gas turbine engine of FIG. 1.
Figure 3:
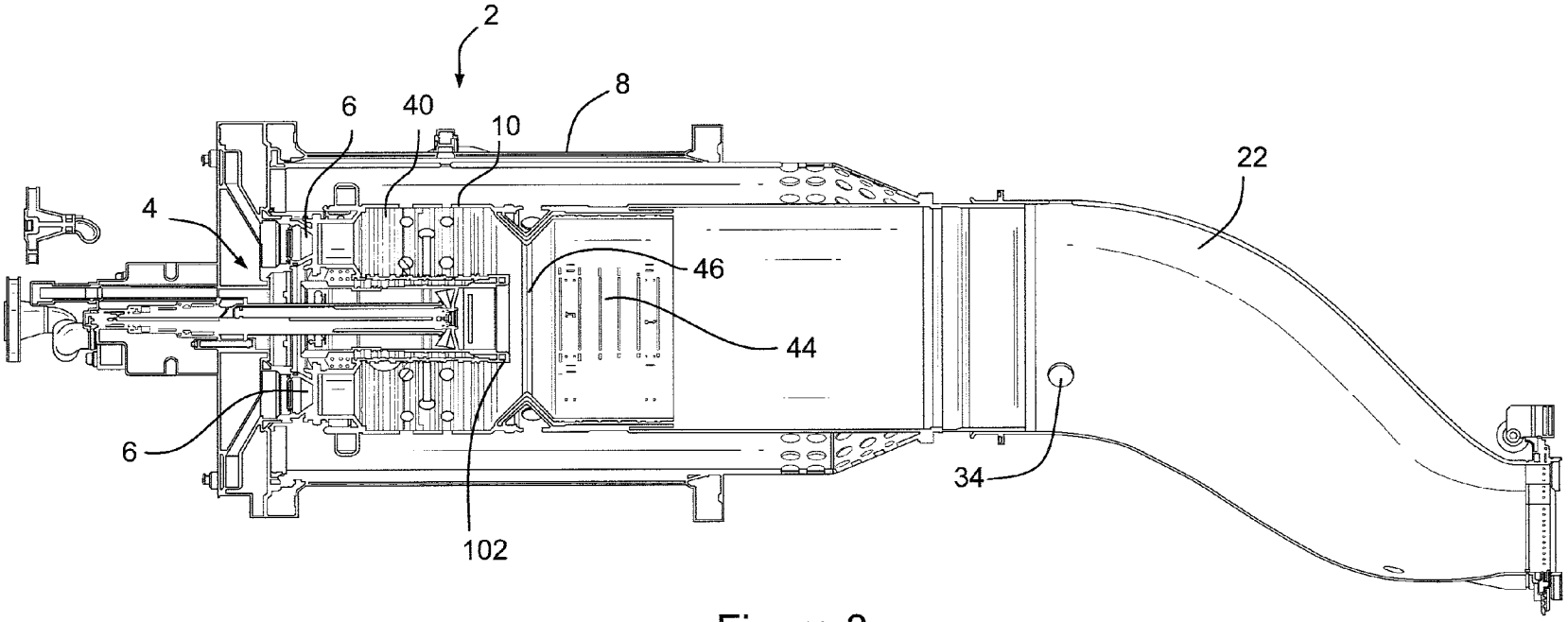
FIG. 3 schematically depicts a combustor according to an exemplary embodiment of the invention.

Referring to FIG. 3, a combustor 2 according to an embodiment includes a combustor head end 4 having an array of primary nozzles 6 and a secondary nozzle 102. A combustion chamber liner 10 comprises a venturi 46 provided between a primary combustion chamber 40 and a secondary combustion chamber 44. The combustion chamber liner 10 is provided in a combustor flow sleeve 8. A transition duct 22 is connected to the combustion chamber liner 10 to direct the combustion gases to the turbine. Dilution holes 34 may be provided in the transition duct 22 for late lean injection.

Figure 4:
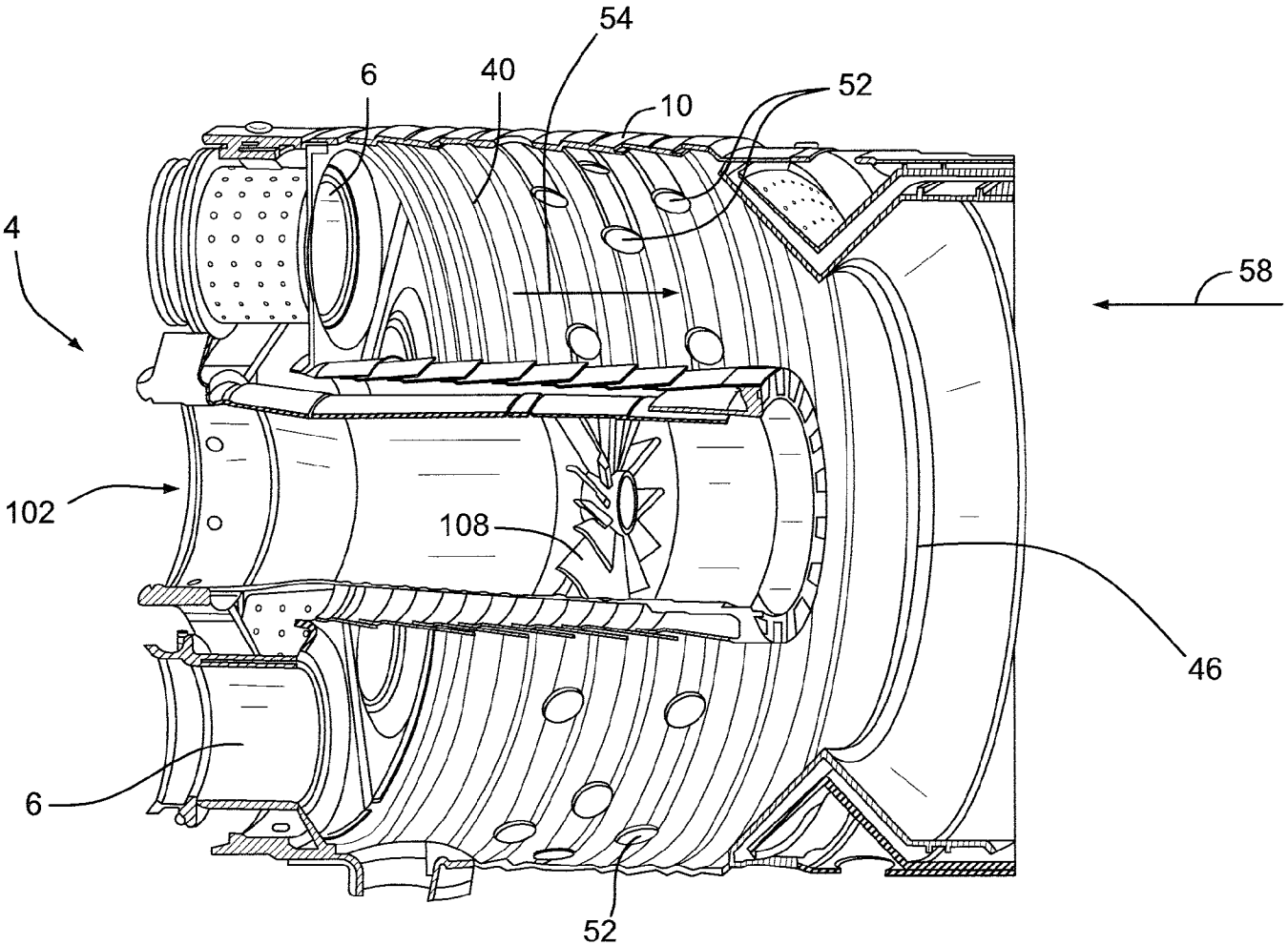
FIG. 4 schematically depicts a combustor head end according to an exemplary embodiment of the invention and a combustion liner taken from FIG. 3.

Referring to FIG. 4, the combustor head end 4 comprises the array of primary nozzles 6 and the secondary nozzle 102. As shown in FIG. 4, the primary nozzles 6 are provided in a circular array around the secondary nozzle 102. It should be appreciated, however, that other arrays of the primary nozzles 6 may be provided.

The combustion chamber liner 10 comprises a plurality of combustion chamber liner holes 52 through which compressed air flows to form an air flow 54 for the primary combustion chamber 40. It should also be appreciated that compressed air flows on the outside of the combustion chamber liner 10 to provide a cooling effect to the primary combustion chamber 40.

The secondary nozzle 102 comprises a plurality of swirl vanes 108 that are configured to pre-mix fuel and air as will be described in more detail below. The secondary nozzle 102 extends into the primary combustion chamber 40, but not so far as the venturi 46.

Figure 5:
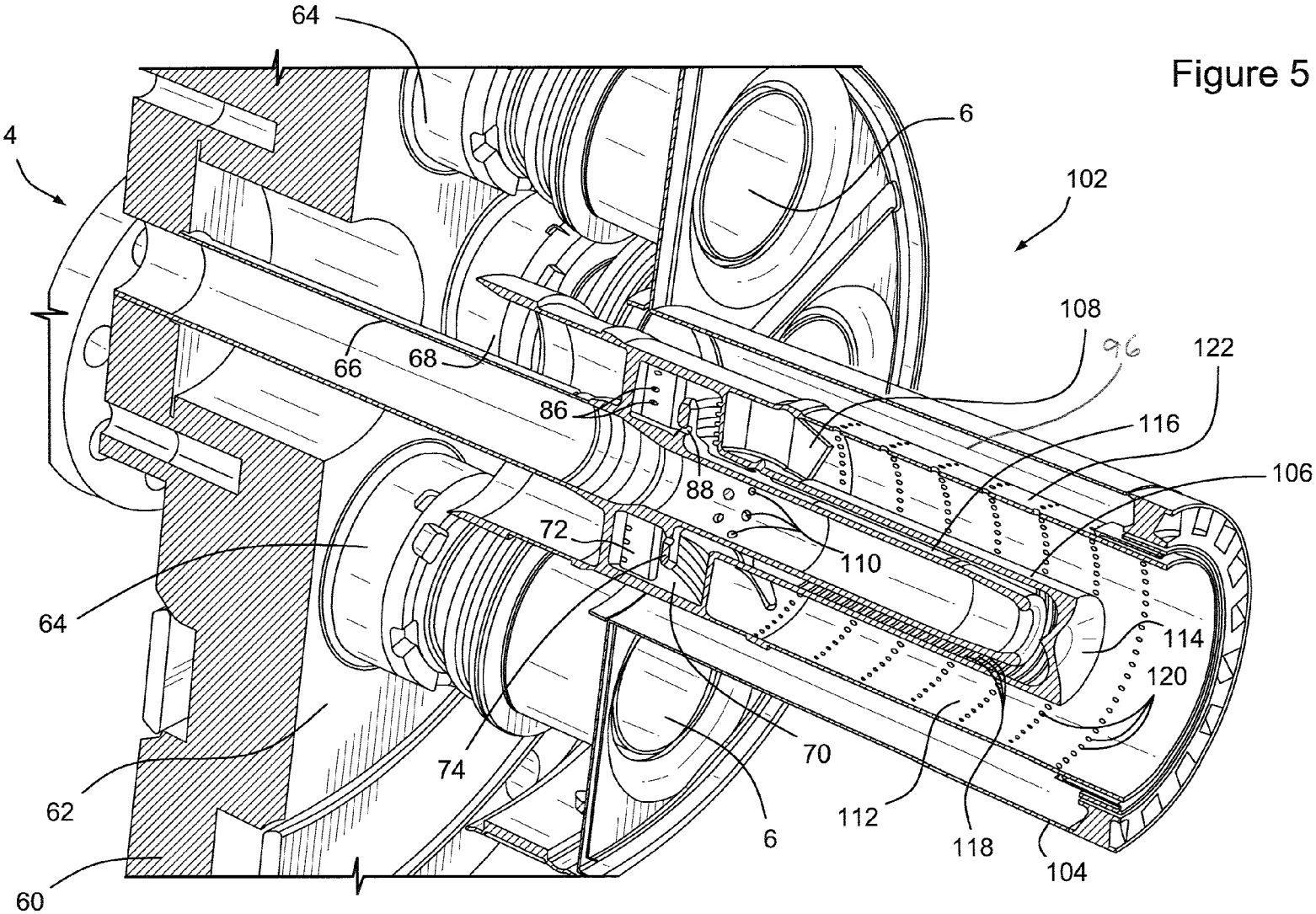
FIG. 5 schematically depicts the combustor head end of FIG. 4 including a flame tolerant secondary fuel nozzle according to an exemplary embodiment of the invention.

Referring to FIG. 5, the combustor head end 4 comprises an end cover 60 having an end cover surface 62 to which the primary nozzles 6 are connected by sealing joints 64. The secondary nozzle 102 comprises a fuel passage 66 that is supported by the end cover 60. The secondary nozzle 102 further comprises an air flow inlet 68 for the introduction of air into the secondary nozzle 102.

A nozzle center body 106 surrounds the end portion of the fuel passage 66. The nozzle center body 106 comprises an end wall 114. In the fuel passage 66, the fuel flows downstream until it contacts the end wall 114. The fuel flow then enters a reverse flow passage 116 and flows upstream as explained further below. As used herein, the term downstream refers to a direction of flow of the combustion gases through the combustor toward the turbine and the term upstream may represent a direction away from or opposite to the direction of flow of the combustion gases through the combustor.

The nozzle center body 106 may comprise annular ribs 118 to enhance heat transfer and cool the outer surface of the center body 106. It should also be appreciated that the fuel passage 66 may comprise ribs, for example on the outer circumferential surface. The fuel passage 66 may comprise a plurality of holes 110 that bypass fuel directly to the swirling vanes 108 to control cooling and the pressure drop in the secondary nozzle 102.

The fuel flows upstream in the reverse flow passage 116 into a cooling chamber 70. The fuel then flows around a divider 74 into an outlet chamber 72. The divider 74 may, for example, be a piece of metal that restricts the direction of flow of the fuel into the outlet chamber 72, thus causing the fuel to internally cool all surfaces of the vanes 108. The cooling chamber 70 and the outlet chamber 72 may be described as a non-linear coolant flow passage, e.g., a zigzag coolant flow passage, a U-shaped coolant flow passage, a serpentine coolant flow passage, or a winding coolant flow passage. A portion of the fuel may also flow directly from the cooling chamber 70 to the outlet chamber 72 through a by-pass hole 88 formed in the divider 74.

The by-pass hole 88 may allow, for example, approximately 1-50%, 5-40%, or 10-20%, of the total fuel flow flowing from the cooling chamber 70 into the outlet chamber 72 to flow directly between the chambers 70, 72. Utilization of the by-pass hole 88 may allow for adjustments to any fuel system pressure drops that may occur, adjustments for conductive heat transfer coefficients, or adjustments to fuel distribution to fuel injection ports 86. The by-pass hole 88 may improve the distribution of fuel into and through the fuel injection ports 86 to provide more uniform distribution. The by-pass hole 88 may also reduce the pressure drop from the cooling chamber 70 to the outlet chamber 72, thereby helping to force the fuel through the fuel injection ports 86. Additionally, the use of the by-pass hole 88 may allow for tailored flow through the fuel injection ports 86 to change the amount of swirl that the fuel flow contains prior to injection into a fuel-air mixing passage 112 via the injection ports 86.

The fuel is ejected from the outlet chamber 72 through the fuel injection ports 86 formed in the swirl vanes 108. The fuel is injected from the fuel injection ports 86 into the fuel-air mixing passage 112 for mixing with the air flow from the air flow inlet 68 of the secondary nozzle 102. The swirl vanes 108 swirl the air flow from the air flow inlet 68 to improve the fuel-air mixing in the passage 112.

Referring still to FIG. 5, the secondary nozzle 102 includes a burner tube 122 that surrounds the nozzle center body 106. The fuel-air mixing passage 112 is provided between the nozzle center body 106 and the burner tube 122. An outer peripheral wall 104 is provided around the burner tube 122 and defines a passage 96 for air flow. The burner tube 122 includes a plurality of rows of air cooling holes 120 to provide for cooling by allowing the coolant to form a film on the burner tube, protecting it from hot combustion gases. Coolant is also directed axially upstream within an annular cavity formed between the burner tube 122 and the outer peripheral wall 104, in order that coolant may exit the cooling holes 120 upstream of the leading half of vanes 108. The holes 120 may be angled in the range of 0° to 45° degree with reference to a downstream wall surface. The hole size, the number of holes in a circular row, and/or the distance between the hole rows may be arranged to achieve the desired wall temperature during flame holding events.

Figure 6:
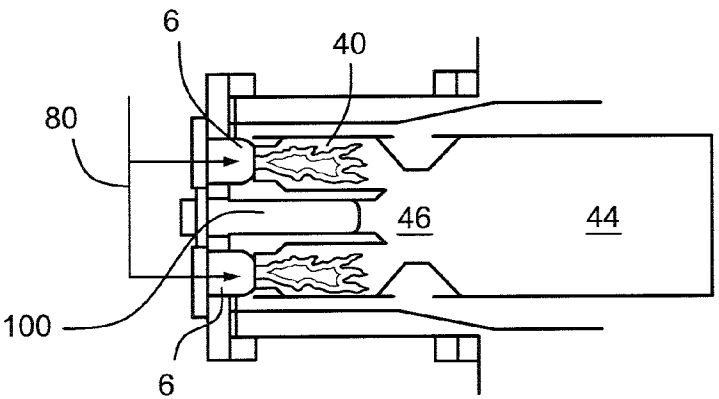

Operation of the combustor will now be described with reference to FIGS. 6-9. As shown in FIG. 6, during primary operation, which may be from ignition up to, for example, 20% of the load of the gas turbine engine, all of the fuel supplied to the combustor is primary fuel 80, i.e. 100% of the fuel is supplied to the array of primary nozzles 6. Combustion occurs in the primary combustion chamber 40 through diffusion of the primary fuel 80 from the primary fuel nozzles 6 into the air flow 54 through the combustor 4.

Figure 7:
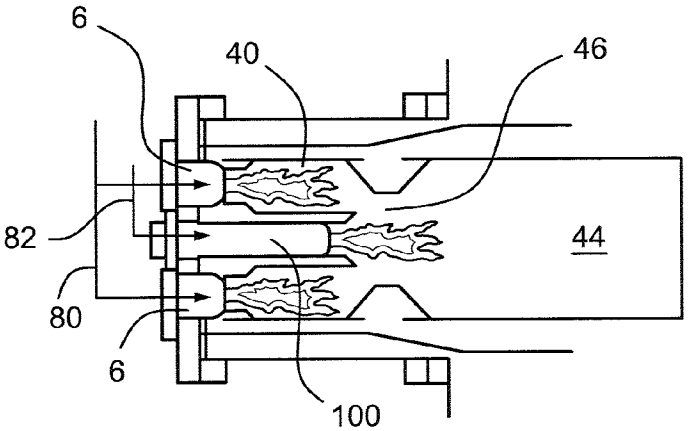
FIGS. 6-9 schematically depict operation of a combustor according to an exemplary embodiment of the invention.

As shown in FIG. 7, a lean-lean operation of the combustor occurs when the gas turbine engine is operated at, for example, 20-50% of the load of the gas turbine engine. Primary fuel 80 is provided to the array of primary nozzles 6 and secondary fuel 82 is provided to the secondary nozzle 102. For example, about 70% of the fuel supplied to the combustor is primary fuel 80 and about 30% of the fuel is secondary fuel 82. Combustion occurs in the primary combustion chamber 40 and the secondary combustion chamber 44.

As used herein, the term primary fuel refers to fuel supplied to the primary nozzles 6 and the term secondary fuel refers to fuel supplied to the secondary nozzle 102.

Figure 8:
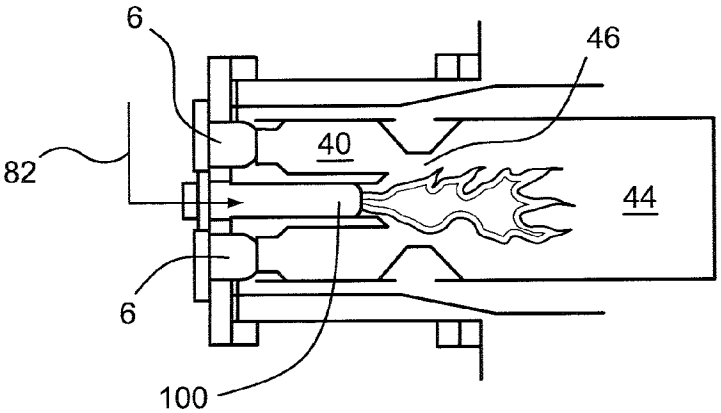

In a second-stage burning, shown in FIG. 8, which is a transition from the operation of FIG. 7 to a pre-mixed operation described in more detail below with reference to FIG. 9, all of the fuel supplied to the combustor is secondary fuel 82, i.e. 100% of the fuel is supplied to the secondary nozzle 102. In the second-stage burning, combustion occurs through premixing of the secondary fuel 82 and the air flow from the inlet 68 of the secondary nozzle 102. The pre-mixing occurs in the pre-mixing passage 112 of the secondary nozzle 102.

Figure 9:
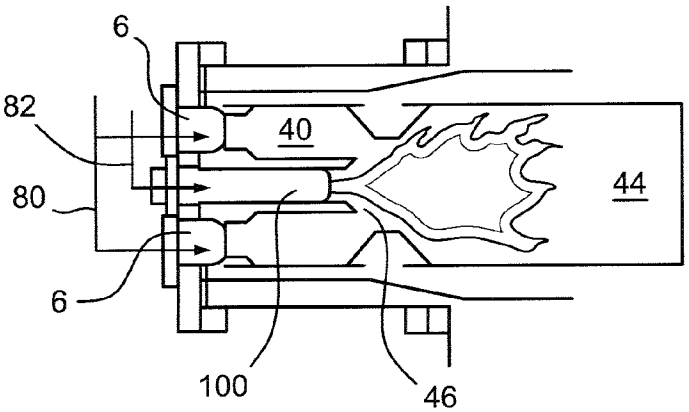

As shown in FIG. 9, the combustor may be operated in a pre-mixed operation at which the gas turbine engine is operated at, for example, 50-100% of the load of the gas turbine engine. In the pre-mixed operation of FIG. 9, the primary fuel 80 to the primary nozzles 6 is increased from the amount provided in the lean-lean operation of FIG. 7 and the secondary fuel 82 to the secondary nozzle 102 is decreased from the amount from provided in the lean-lean operation shown in FIG. 7. For example, in the pre-mixed operation of FIG. 9, about 80-83% of the fuel supplied to the combustor may be primary fuel 80 and about 20-17% of the fuel supplied to the combustor may be secondary fuel 82.

As shown in FIG. 9, during the pre-mixed operation, combustion occurs in the secondary combustion chamber 44 and damage to the secondary nozzle 102 is prevented due to the cooling measures. Referring to FIG. 4, flashback may occur in the event that the flame speed 58 is greater than the velocity of the air flow 54 in the primary combustion chambers 40. Control of the air-fuel mixture in the secondary nozzle 102, i.e. control of the secondary fuel 82, provides control of the flame speed and prevents the flame from crossing the venturi 46 into the primary combustion chamber 40.

Figure 10:
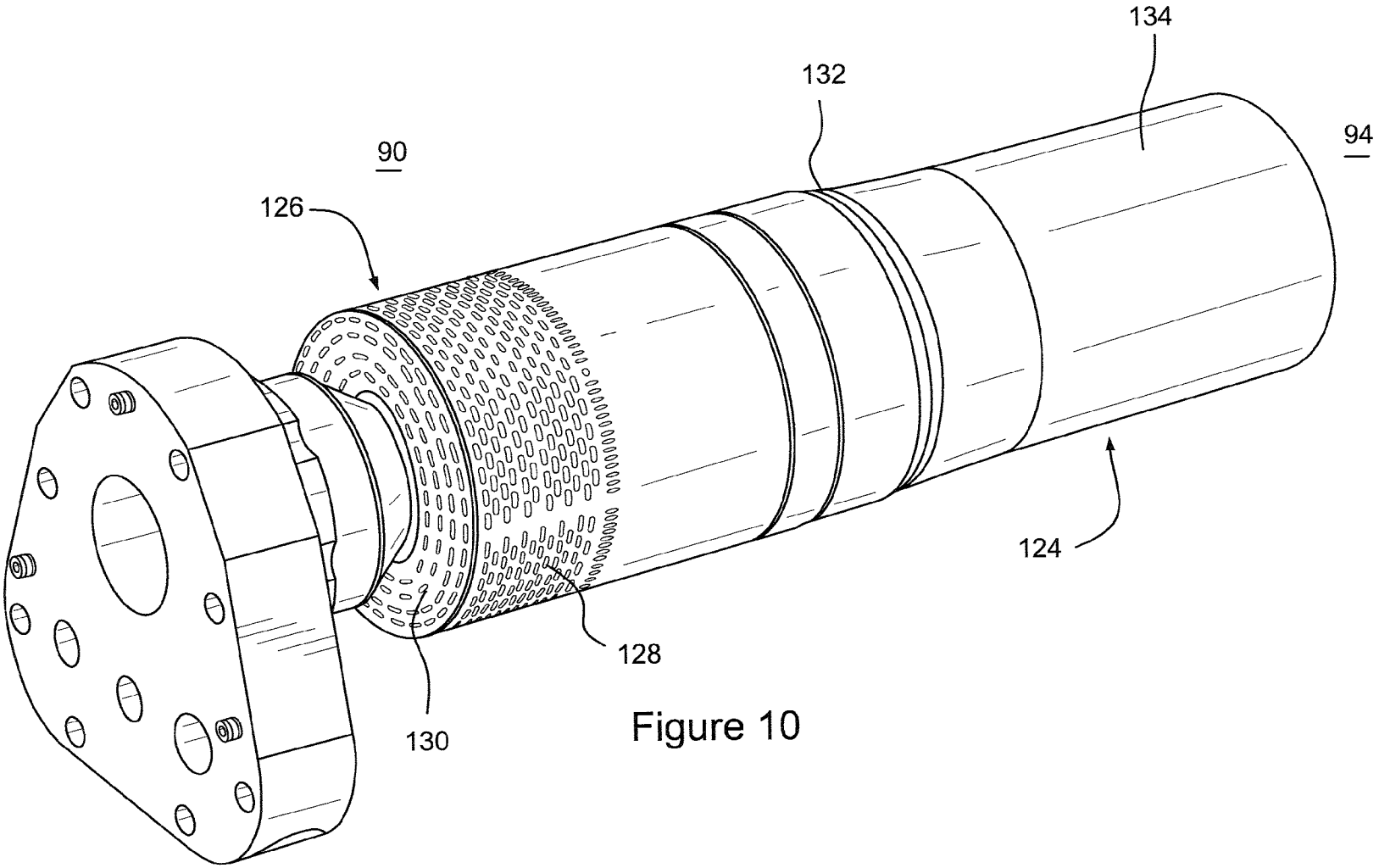
FIGS. 10 and 11 disclose a flame tolerant secondary fuel nozzle according to an exemplary embodiment of the invention.
Figure 11:
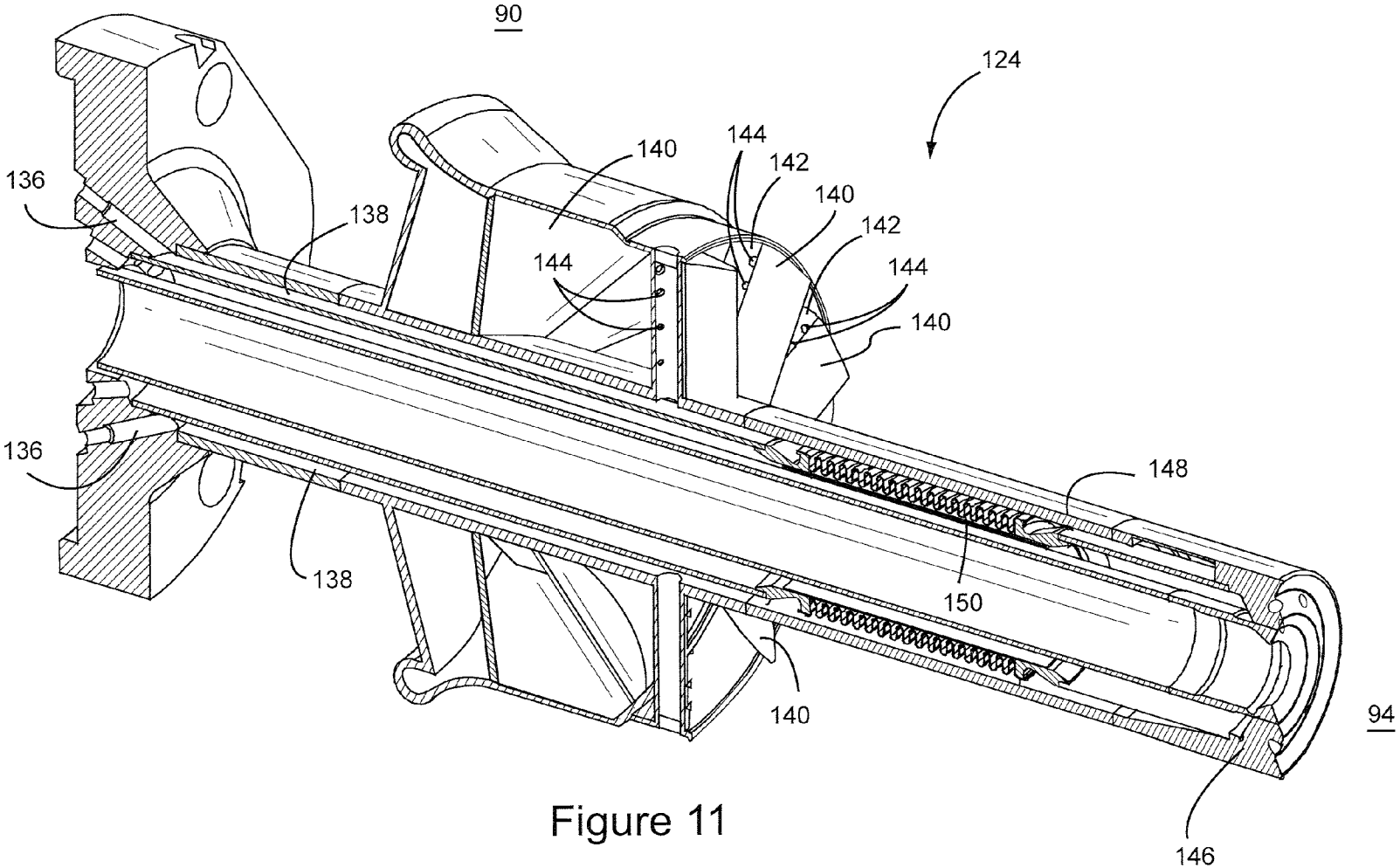

Referring to FIGS. 10 and 11, secondary nozzle 124 comprises an inlet flow conditioner (IFC) 126, an air swirler assembly 132 with natural gas fuel injection, and a diffusion gas tip 146. A shroud extension 134 extends from the air swirler assembly 132.

Air enters the secondary nozzle 124 from a high pressure plenum 90, which surrounds the entire secondary nozzle 124 except the discharge end, which enters the combustor reaction zone 94. Most of the air for combustion enters the premixer via the IFC 126. The IFC 126 includes a perforated cylindrical outer wall 128 at the outside diameter, and a perforated end cap 130 at the upstream end. Premixer air enters the IFC 126 via the perforations in the end cap 130 and the cylindrical outer wall 128.

The function of the IFC 126 is to prepare the air flow velocity distribution for entry into the premixer. The principle of the IFC 126 is based on the concept of backpressuring the premix air before it enters the premixer. This allows for better angular distribution of premix air flow. The perforated wall and endcap 128, 130 perform the function of backpressuring the system and evenly distributing the flow circumferentially around the IFC annulus. Depending on the desired flow distribution within the premixer, appropriate hole patterns for the perforated wall and endcap 128, 130 are selected.

Referring to FIG. 11, the air swirler assembly of the secondary nozzle 124 comprises a plurality of swirling vanes 140 and a plurality of spokes, or pegs, 142 provided between the swirling vanes 140. Each spoke 142 comprises a plurality of fuel injection holes 144 for injecting fuel into the air swirled by the vanes 140. Natural gas inlet ports 136 allow natural gas to be introduced into fuel passages 138 that are in communication with the spokes 142. A nozzle extension 148 is provided between the air swirler assembly and the diffusion gas tip 146. A bellows 150 may be provided to compensate for differences in thermal expansions.

Although the various embodiments described above include diffusion nozzles as the primary nozzles, it should be appreciated that the primary nozzles may be premixed nozzles, for example having the same or similar configuration as the secondary nozzles.

The flame tolerant nozzle enhances the fuel flexibility of the combustion system. The flame tolerant nozzle as the secondary nozzle in the combustor makes the combustor capable of burning full syngas as well as natural gas. The flame tolerant nozzle may be used as a secondary nozzle in the combustor and thus make the combustor capable of burning full syngas or high hydrogen, as well as natural gas. The flame tolerant nozzle, combined with a primary dual fuel nozzle, will make the combustor capable of burning both natural gas and full syngas fuels. It expands the combustor's fuel flexibility envelope to cover a wide range of Wobbe number and reactivity, and can be applied to oil and gas industrial programs.

The cooling features of the flame tolerant nozzle, including for example, the fuel cooled center body, the tip of the center body, the swirling vanes of the pre-mixer, and the air cooled burner tube, enable the nozzle to withstand prolonged flame holding events. During such a flame holding event, the cooling features protect the nozzle from any hardware damage and allows time for detection and correction measures that blow the flame out of the pre-mixer and reestablish pre-mixed flame under normal mode operation.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A combustor for a gas turbine engine, comprising:

a plurality of primary nozzles configured to diffuse fuel into an air flowing through the combustor in a downstream direction; and a secondary nozzle configured to premix fuel with the air flow, the secondary nozzle comprising:

a fuel passage extending downstream in the combustor and having a downstream end portion, a center body provided around the fuel passage, a burner tube provided around the center body and defining an annular air-fuel mixing passage between the center body and the burner tube, wherein the burner tube includes an inlet open to a volume of air flow;

at least one vane assembly in the annular air-fuel mixing passage and upstream of the downstream end portion of the fuel passage, the at least one vane assembly including an internal chamber and swirl vanes wherein the internal chamber is upstream of the swirl vanes, and at least two cooling passages comprising a fuel cooling passage to cool surfaces of the center body and the at least one vane assembly, and an air cooling passage to cool a wall of the burner tube, wherein the fuel passage is configured to pass fuel in a downstream direction of the combustor and the fuel cooling passage includes an inlet to the fuel cooling passage proximate the downstream end of the fuel passage and an outlet of the fuel cooling passage open to the internal chamber of the at least one vane assembly and the air cooling passage is open to the volume of air flow providing air to the burner tube.

2. A combustor according to claim 1, wherein the fuel passage includes at least one hole configured to split fuel between impingement cooling a head end of center body and bypassing the reverse fuel passage.

3. A combustor according to claim 1, wherein the burner tube provided around the center body defines a fuel-air premixing passage and the burner tube wall is film-cooled by compressed air in the air cooling passage between the burner tube and an outer peripheral wall.

4. A combustor according to claim 3, wherein the internal chamber of the at least one vane assembly includes a cooling chamber configured to receive fuel from the fuel cooling passage, an outlet chamber configured to expel the fuel through at least one fuel injection port in the at least one vane assembly into the fuel-air premixing passage, and at least one divider provided between the cooling chamber and the outlet chamber to define a non-linear fuel path.

5. A combustor according to claim 4, wherein the at least one divider is provided with a by-pass hole configured to permit fuel flow directly from the cooling chamber to the outlet chamber.

6. A combustor according to claim 1, further comprising an inlet flow conditioner configured to angularly distribute the air flow.

7. A combustor according to claim 1, wherein the at least one vane assembly includes at least one spoke including at least one fuel injection hole configured to inject fuel into the air flowing the at least one vane.

8. A combustor according to claim 3, further comprising a plurality of circular rows of air cooling holes in the burner tube wall, each hole comprising an injection angle in the range of 0° to 45° with respect to a downstream wall surface, wherein a size of each hole, a number of holes in each circular row, and/or a distance between adjacent circular rows are arranged to achieve a desired wall temperature during flame holding events.

9. A combustor according to claim 1, wherein an air-fuel premixture is configured to produce a flame speed that is less than a velocity of the air flow.

10. A combustor according to claim 9, further comprising:

a primary combustion chamber;

a secondary combustion chamber; and a venturi between the primary combustion chamber and the secondary combustion chamber, wherein the air-fuel premixture is configured to produce a flame in the secondary combustion chamber that does not cross the venturi into the primary combustion chamber.

11. A method of operating a combustor of a gas turbine engine, the combustor comprising a plurality of primary nozzles provided in a primary combustion chamber and configured to diffuse fuel of a fuel supply to the combustor into an air flow through the combustor; and a secondary nozzle provided in a secondary combustion chamber and configured to premix fuel of the fuel supply with the air flow, the secondary nozzle comprising a a fuel passage, a center body provided around the fuel passage, a burner tube provided around the center body and defining an annular air-fuel mixing passage between the center body and the burner tube, at least one vane assembly in the annular air-fuel mixing passage including an internal chamber and swirl vanes downstream of the internal chamber and configured to swirl the air flow, and at least two cooling passages comprising a fuel cooling passage to cool surfaces of the center body and the at least one vane, and an air cooling passage to cool a wall of the burner tube, the method comprising:

providing an air flow to the combustor;

providing a fuel supply to at least one of the plurality of primary nozzles and the secondary nozzle;

diffusing fuel supplied to the primary nozzles into the air flow;

premixing fuel supplied to the secondary nozzle with the air flow, wherein the air flow enters the burner tube and mixes with fuel discharged from the vane assembly;

cooling the center body and the at least one vane assembly with a portion of the fuel in the fuel cooling passage, wherein fuel flows through the fuel cooling passage in an upstream direction as compared to the downstream direction of the combustor and fuel from the fuel cooling passage passes through the internal chamber within the at least one vane, wherein the cooling of the vane assembly;

discharging the fuel from the internal chamber through fuel injection apertures arranged on the vane assembly and upstream of the swirl vanes, and film cooling the burner tube with a portion of the air flow in the air cooling passage between the burner tube and an outer peripheral wall by providing film cooling holes in the burner tube.

12. A method according to claim 11, further comprising:

passing fuel in a downstream direction of the combustor through a fuel passage; and passing fuel in an upstream direction of the combustor through a reverse fuel passage defined by the center body provided around the fuel passage to cool the outer surface of the center body.

13. A method according to claim 12, further comprising:

splitting fuel from the fuel passage to impinge cool the center body's head end and bypass the reverse fuel passage.

14. A method according to claim 11, further comprising determining an air-fuel premixture configured to produce a flame speed that is less than a velocity of the air flow.

15. A method according to claim 14, wherein a venturi is provided between the primary combustion chamber and the secondary combustion chamber, the method further comprising:

producing a flame in the secondary combustion chamber that does not cross the venturi into the primary combustion chamber.

16. A method according to claim 11, wherein upon ignition of the combustor up to a first predetermined percentage of a load of the gas turbine engine, the method comprises:

providing the entire fuel supply to the primary nozzles.

17. A method according to claim 16, wherein from the first predetermined percentage of the load to a second predetermined percentage of the load higher than the first predetermined percentage of the load, the method comprises:

providing a first percentage of the fuel supply to the primary nozzles and a second percentage of the fuel supply to the secondary nozzle, the first percentage being larger than the second percentage.

18. A method according to claim 17, the method further comprising:

providing a third percentage of the fuel supply to the primary nozzles and a fourth percentage of the fuel supply to the secondary nozzle from the second predetermined percentage of the load to 100% of the load of the gas turbine engine, wherein the third percentage of the fuel supply is higher than the first percentage of the fuel supply and the fourth percentage of the fuel supply is smaller than the second percentage of the fuel supply.

19. A method according to claim 18, wherein prior to providing the third percentage of the fuel supply to the primary nozzles and the fourth percentage of the fuel supply to the secondary nozzle, the method comprises:

providing 100% of the fuel supply to the secondary nozzle.

20. A combustor for a gas turbine engine comprising:

primary nozzles configured to diffuse fuel into an air flowing through the combustor in a downstream direction;

an end cover having openings to receive a discharge end of each of the primary nozzles;

a secondary nozzle configured to premix fuel with the air flow wherein the primary nozzles are arranged in an annular array and the secondary nozzle is aligned with a centerline of the array and the secondary nozzle extends through the end cover and downstream into the combustor in a direction of combustion gas flow, the secondary nozzle comprising;

a tubular fuel passage extending downstream in the combustor and having a downstream end portion, a tubular center body provided around the fuel passage, a burner tube provided around the center body and defining an annular air-fuel mixing passage between the center body and the burner tube, wherein the burner tube includes an inlet upstream of the end cover and open to an airflow, a vane assembly in the annular air-fuel mixing passage and upstream of the downstream end portion of the fuel passage, the at least one vane assembly including an internal chamber and an annular array of swirl vanes;

a reverse flow fuel cooling passage defined between the fuel passage and the center body, wherein the reverse flow fuel cooling passage includes a fuel inlet open to the fuel passage and proximate a downstream end of the fuel passage and an outlet upstream in a direction of combustion gas flow of the downstream end and aligned with the vane assembly, wherein the outlet of the reverse flow fuel cooling passage is in fluid communication with the internal chamber of the vane assembly, and an outer wall tube surrounding the burner tube and having an inlet end region connected to the end cover wherein the air flow enters the outer wall tube and flows through an annular cooling air passage between the burner tube and the outer wall tube.

21. The combustor of claim 20 wherein the internal chamber of the vane assembly includes an annular cooling chamber open to the outlet of the reverse fuel cooling passage, an annular outlet chamber separated by a dividing wall from the cooling chamber, wherein apertures adjacent the outlet chamber allow cooling fuel to flow towards the swirl vanes.

* * * * *